US005755118A

United States Patent [19]

Woo

[11] Patent Number: 5,755,118

[45] Date of Patent: May 26, 1998

[54] WATER LEVEL MEASURING APPARATUS FOR WASHING MACHINE

[75] Inventor: Kyung-Chul Woo, Seoul, Rep. of Korea

[73] Assignee: L.G. Electronics Inc., Seoul, Rep. of Korea

[21] Appl. No.: 746,578

[22] Filed: Nov. 14, 1996

[30] Foreign Application Priority Data

Nov. 20, 1995 [KR] Rep. of Korea ..... 42228/1995

[51] Int. Cl.[6] ..... D06F 33/02

[52] U.S. Cl. ..... 68/12.21; 68/12.27; 68/207

[58] Field of Search ..... 68/12.02, 12.05, 68/12.21, 12.27, 207

[56] References Cited

U.S. PATENT DOCUMENTS 5,272,892 12/1993 Janutka et al. ..... 68/12.02

*Primary Examiner*—Philip R. Coe

*Attorney, Agent, or Firm*—Ostrolenk, Faber, Gerb & Soffen, LLP

[57] ABSTRACT

A water level measuring apparatus for a washing machine which is capable of sensing the water level depending on a level of a sound made by a falling water when water is supplied, includes a microphone disposed at an interval from a water supply inlet to sense the sound of the falling water, a microphone amplifier for amplifying the sound sensed through the microphone, and a microcomputer for determining a water level by using an output signal from the microphone amplifier.

4 Claims, 3 Drawing Sheets

WATER LEVEL MEASURING APPARATUS FOR WASHING MACHINE

BACKGROUND OF THE INVENTION

1. Field of the Invention

The present invention relates to a water level measuring apparatus for a washing machine, and more particularly, to an improved water level measuring apparatus for a washing machine which is capable of sensing the water level based on the sound made by the supplied water falling into the tub of the washing machine.

2. Description of the Prior Art

FIG. 1 is a schematic view showing a washing machine according to the conventional art, which includes an inner tub 10 for receiving laundry and water for carrying out a washing operation, a water supply inlet 11 for supplying hot water and cold water to the inner tub 10, an outer tub 12, a water level sensor 14 mounted on an upper portion of the outer tub 12 through a tube 13 communicated to a side wall at a lower portion of the outer tub 12, a pulsator 15 for mixing the laundry and water in washing and rinsing, a motor 16 for generating power, a clutch 17 for receiving the power from the motor 16 to rotate the pulsator 15 in washing and rinsing and rotating the inner tub 10 and the pulsator 15 in drying, and a drain valve 18 disposed at a lower portion of the outer tub 12 to discharge water.

Here, reference numerals 20,21 designate hot & cold water valves, respectively, for controlling the amount of water supplied to the inner tub 10 through the inlet 11.

A motor pulley 16' and a clutch pulley 17' are connected by a belt 19, and power is transmitted from the motor 16 to the clutch 17.

FIG. 2 is a view showing an inner structure of the water level sensor 14 in FIG. 1. As shown in this drawing, the water level sensor 14 includes an air chamber 14-1 communicated to the outer tub 12 through the tube 13, a core-guide 14-2 composed of a flexible rubber diaphragm and moving up and down in accordance with the pressure in the air chamber 14-1, and a core 14-3 moving up and down in a coil (L1) in accordance within the up and down movement of the core-guide 14-2.

The operation of the conventional washing machine having the above structure will now be described in detail with reference to FIGS. 1 and 2.

In a washing or rinsing cycle, when a user puts laundry into the inner tub 10 and controls a hot or cold water valve 20 or 21 according to a key selection, hot or cold water is supplied through the water supply inlet 11.

Here, the water supplied to the inner tub 10 fills into the tube 13 to pressurize the air in the air chamber 14-1, and the pressurized air pushes the core-guide 14-2 mounted in the water level sensor 14 upward, causing the core 14-3 to move according to the upward movement of the core-guide 14-2 towards the upper end of the coil (L1).

Then, as the position of the core 14-3 within the coil (L1) winding is changed, the change of the position causes the value of the reactance of the coil (L1) to be changed. As a result, the value of a frequency oscillated in accordance with the value of the coil (L1) and a condenser (not illustrated) is changed.

Consequently, a predetermined look-up table based on the changed frequency values according to the varying water levels is pre-programmed so that the water level can be detected according to the frequency.

Then, as water is supplied to the inner tub 10 and the oscillation value reaches a set frequency, that is, corresponding to a set water level, the water supply is stopped and the motor is actuated to operate the pulsator 15 by the motor 16 and the clutch 17, and thereby a washing & rinsing cycle is carried out.

However, since the conventional water level sensor has many components and uses a diaphragm or a spring as a device for transmitting pressure, a secure mechanical characteristic cannot be embodied.

Further, since the diaphragm or spring is easily affected by the washing machine usage, it has a short life span and requires a delicate manufacture in producing the sensor.

SUMMARY OF THE INVENTION

Accordingly, it is an object of the present invention to provide an improved water level measuring apparatus for a washing machine which is capable of sensing the water level based on the sound made by the supplied water falling into the tub of the washing machine.

To achieve the above object, there is provided an improved water level measuring apparatus for a washing machine having an inner tub for carrying out a washing after being supplied with laundry and water and a water supply inlet for supplying hot or cold water to the inner tub, which includes a microphone disposed at a predetermined interval from the water supply inlet to sense the sound of supplied water falling into the inner tub, a microphone amplifier for amplifying the sound sensed through the microphone, and a microcomputer for determining a water level by using an output signal from the microphone amplifier.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
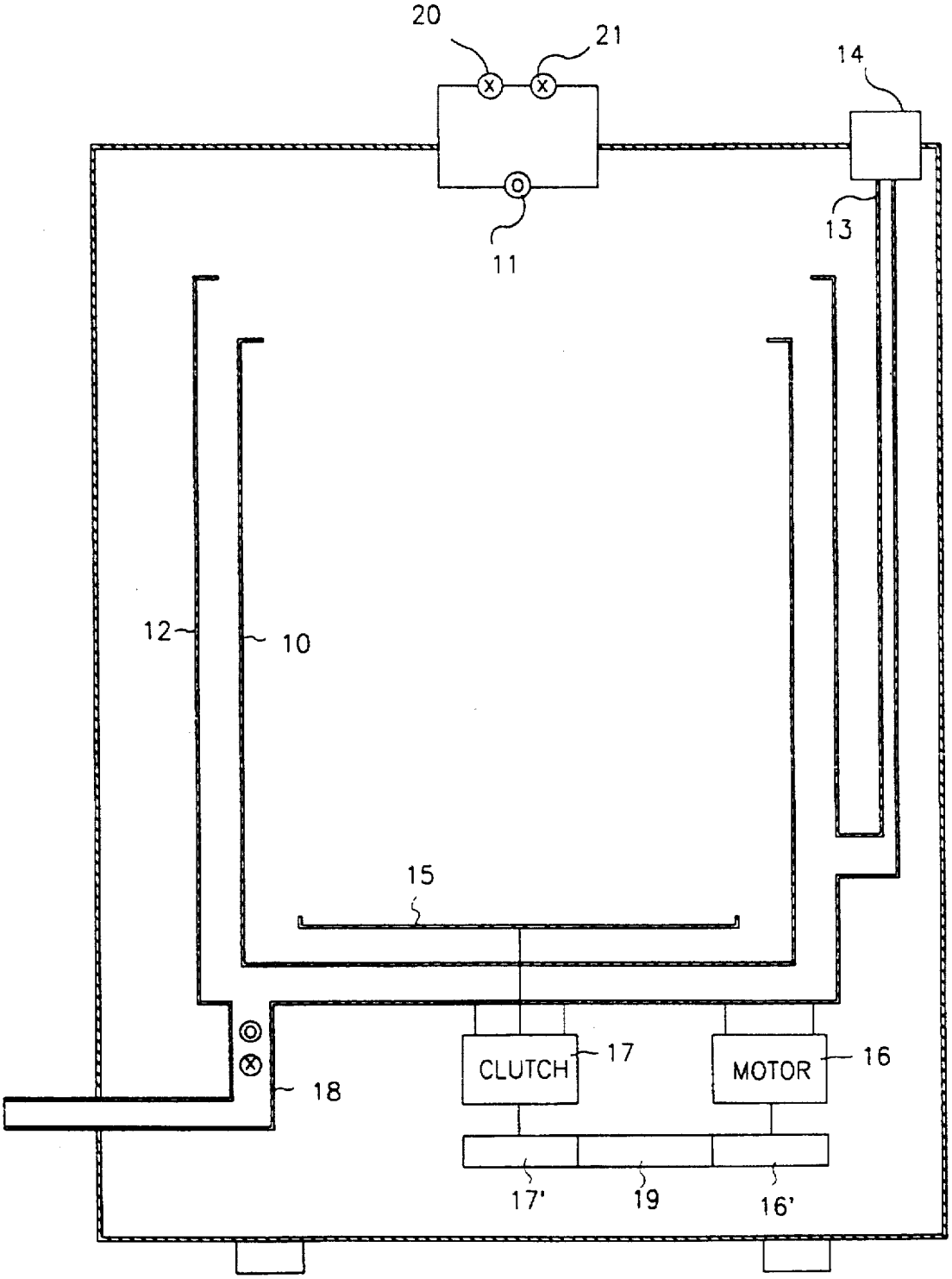
FIG. 1 CONVENTIONAL ART
FIG. 1 is a schematic view showing a washing machine according to the conventional art.
Figure 2:
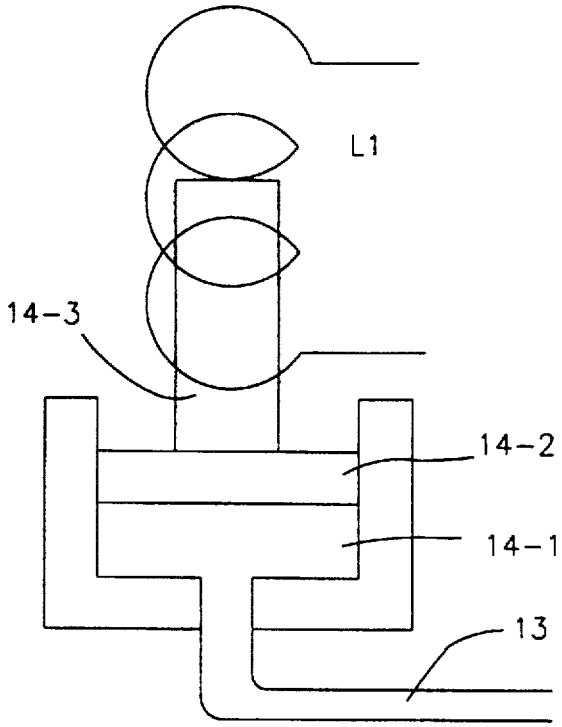
FIG. 2 CONVENTIONAL ART
FIG. 2 is a view showing an inner structure of the conventional water level sensor equipped in the washing machine of FIG. 1.
Figure 3:
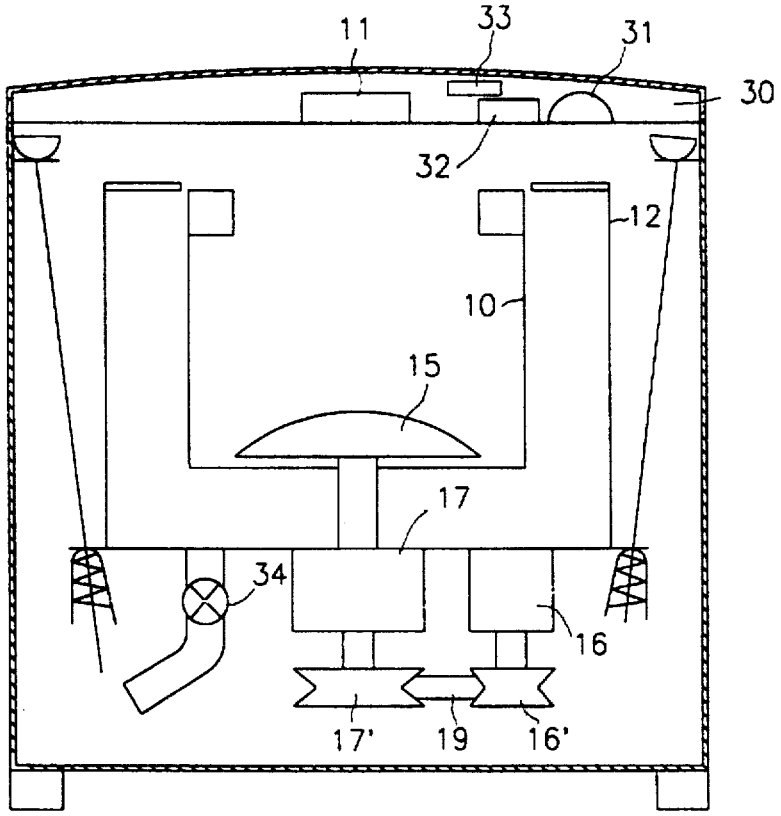
FIG. 3 is a view showing the structure of a washing machine having a water level measuring apparatus disposed therein according to the present invention.

A water level measuring apparatus according to the present invention, as shown in FIG. 3, includes a microphone 31 disposed at a certain spacing the right or left side of a water supply inlet 11 mounted under a top cover of the washing machine to sense the sound of water being supplied from the inlet 11 to the inner tub 10, a microphone amplifier 32 for amplifying an output signal from the microphone 31 and a microcomputer 33 for determining the water level by using the output signal from the microphone amplifier 32. Here, reference numeral 34 represents a drain valve.

The operation of the water level sensor in the washing machine having the above structure will now be described in detail.

First, in a washing or rinsing cycle, a user puts laundry into the inner tub 10 and pushes a key (not illustrated) for water supply.

Here, assuming that the amount of the water supplied to the inner tub 10 is constant, the sound transmitted through the microphone 31 in the water supply apparatus is gradually lowered as the water is filled in the inner tub 10.

That is, as the water is filled in the inner tub 10, the falling distance of the water is decreased, and thereby a potential energy depending on the weight of the water is also decreased in accordance with the following equation, resulting in lowering the sound of the falling water.

$$E=mgh \quad (1)$$

(wherein E=potential energy, m=mass, g=acceleration of gravity, and h=height)

Here, as the falling distance is greater, the sound transmitted to the microphone 31 becomes smaller and the water level in the tub may be incorrectly presumed to be high, i.e. almost full. However, in case of a washing machine, since the actual falling distance is very short and the inner tub 10 is enclosed to some degree, the decrease of the sound due to a long falling distance of water is negligible and thus does not affect the water level detection.

The microphone 31 disposed at the right or left side of the water supply inlet 11 senses the sound of the falling water to convert it into an electrical signal, and the converted electrical signal is amplified in the microphone amplifier 32.

Then, the microcomputer 33 measures the water level by using an output signal from the microphone amplifier 32.

Here, when the measured water level reaches an appropriate level, the microcomputer 33 controls the water supply inlet 11 to stop the water supply and operates the motor 16 to perform a washing & rinsing cycle by using the clutch 17 and the pulsator 15.

The water level measuring apparatus for a washing machine according to the present invention carries out a water level measurement, senses noise generated in washing, rinsing and drying, and measures the amount of supplied water by the microphone mounted near the water supply inlet 11.

Further, the present invention can sense the amount of the laundry based upon a decrease of sound made by the laundry put in the tub and the point when the sound is changed.

As described in detail above, the present invention has the effect that the reliability of sensing is improved irrespective of washing machine usage or errors occurring in the washing machine components by measuring the level of the sound according to a falling distance in water supply and by sensing the water level, amount of supplied water and amount of laundry.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A water level measuring apparatus for a washing machine having an inner tub for carrying out a washing after being supplied with laundry and water and a water supply inlet for supplying water to the inner tub, the water level measuring apparatus comprising:

a microphone disposed at a distance from the water supply inlet to sense the audible sound of water supplied at the water supply inlet and falling into the inner tub;

a microphone amplifier for amplifying an output signal generated by the sound sensed by the microphone; and a microcomputer for determining a water level in the inner tub based on the output signal from the microphone amplifier.

2. The apparatus of claim 1, wherein the microphone senses noise generated during washing, rinsing and drying phases of the washing machine.

3. The apparatus of claim 1, wherein the microphone is effective to sense the laundry amount by sensing a change of sound due to the laundry in the inner tub and a point in time when the sound is changed.

4. The apparatus of claim 1, wherein the microphone is effective to sense the sound level of the falling water based on the water's potential energy, mass, falling height and the constant of gravity g in accordance with equation E=2 mgh.

* * * * *